US005185523A

United States Patent [19]

Kitagawa et al.

[11] Patent Number: 5,185,523

[45] Date of Patent: Feb. 9, 1993

[54] MASS SPECTROMETER FOR ANALYZING ULTRA TRACE ELEMENT USING PLASMA ION SOURCE

[75] Inventors: Masatoshi Kitagawa, Mito; Yukio Okamoto, Sagamihara; Takayuki Ono; Tetuya Shinden, both of Katsuta, all of Japan

[73] Assignees: Hitachi, Ltd., Tokyo; Hitachi Instrument Engineering Co., Ltd., Ibaraki, both of Japan

[21] Appl. No.: 848,932

[22] Filed: Mar. 10, 1992

[30] Foreign Application Priority Data

Mar. 12, 1991 [JP] Japan ..... 3-46539

[51] Int. Cl.[5] ..... H01J 49/26

[52] U.S. Cl. ..... 250/281; 250/282; 250/288

[58] Field of Search ..... 250/281, 282, 288 R, 250/288 A; 315/111.21, 111.81, 111.71

[56] References Cited

U.S. PATENT DOCUMENTS 4,948,962 8/1990 Mitsui et al. ..... 250/281

*Primary Examiner*—Jack I. Berman
*Assistant Examiner*—Kiet T. Nguyen
*Attorney, Agent, or Firm*—Antonelli, Terry, Stout & Kraus

[57] ABSTRACT

A mass spectrometer for analyzing ultra trace element using plasma ion source comprising, a plasma generating means for ionizing sampling gas by generating plasma, a vaccum chamber for taking in ions of the sampling gas from a hole of the vacuum chamber, an ion lens and a mass analyzing portion, and an ion detector for detecting the ions which are passed through the ion lens and the mass analyzing portion, wherein further comprising, a moving mechanism for moving said plasma generating means according to a vacuum degree measured in the vacuum chamber so as to make the sensitivity of the mass spectrometer higher.

10 Claims, 4 Drawing Sheets

MASS SPECTROMETER FOR ANALYZING ULTRA TRACE ELEMENT USING PLASMA ION SOURCE

BACKGROUND OF THE INVENTION

The present invention relates to a mass spectrometer for analyzing ultra trace element using plasma ion source and more particularly to the mass spectrometer in which position of a plasma generating portion is optimized so as to improve sensitivity of the mass spectrometer.

In the general mass spectrometer for analyzing ultra trace element, the most popular one is a ICP-mass spectrometry and an example of such device is cited in a publication named "Application of Inductively Coupled Plasma Mass Spectrometry" edited by A. R. Date et al and published by Blackies and Son Ltd. in U.S.A. on 1989. In this publication, it is shown that the mass spectrometer has attained a detecting limitation of PPT level such as 1/10 g/g and has the highest sensitivity than that of any other instrument for measuring the trace element.

In the ICP-mass spectrometry as stated above, nebulized sample is dissociated into ions in air by heat (about 5000-6000 C.) of the ICP plasma and these dissociated ions are transmitted into a vacuum chamber trough an interface so as to be analyzed respective elements by elements with the mass spectrometer.

The every elements are detected by a detector which outputs pulse signals corresponding to the every elements and the pulse signal is amplified and counted by a pulse counter.

The such conventional ICP-mass spectrometry has the highest sensitivity as stated above, but it is difficult to adjust the mass spectrometer so as to detect data in the highest efficiency because the detected data varies depending on various parameter such as voltage of an ion lens, the detecting sensitivity in mass analyzing portion etc. and it takes much times to adjust the mass spectrometer so as to detect data in the highest efficiency.

SUMMARY OF THE INVENTION

The present invention has been accomplished to overcome the above problem of the conventional mass spectrometer.

An object of present invention is to provide a mass spectrometer which is able to detect data in the highest efficiency easily and quickly.

In order to attain the object of present invention, a vacuum gage for measuring a vacuum degree in a first vacuum chamber inside of a plasma sampling hole on a plasma sampling cone and a mechanism for moving plasma generating position manually or automatically according to the vacuum degree in the first vacuum chamber so as to control the vacuum degree of the first vacuum chamber maximum.

DETAILED DESCRIPTION OF THEE PREFERRED EMBODIMENT

In the conventional mass spectrometer, the position of the plasma generating means in from of the ion sampling cone is fixed and optimization of the mass analyzing portion and the ion lens are performed in order to make the sensitivity of the mass spectrometer maximum, but it is very complicated as stated above. In the present invention, it is founded that the position of the plasma generating means in front of the ion sampling cone is very significant in order to optimize the sensitivity of the mass spectrometer, and the position of the plasma generating means is controlled so as to keep vacuum degree of a vacuum chamber closed to the ion sampling cone maximum.

Figure 1:
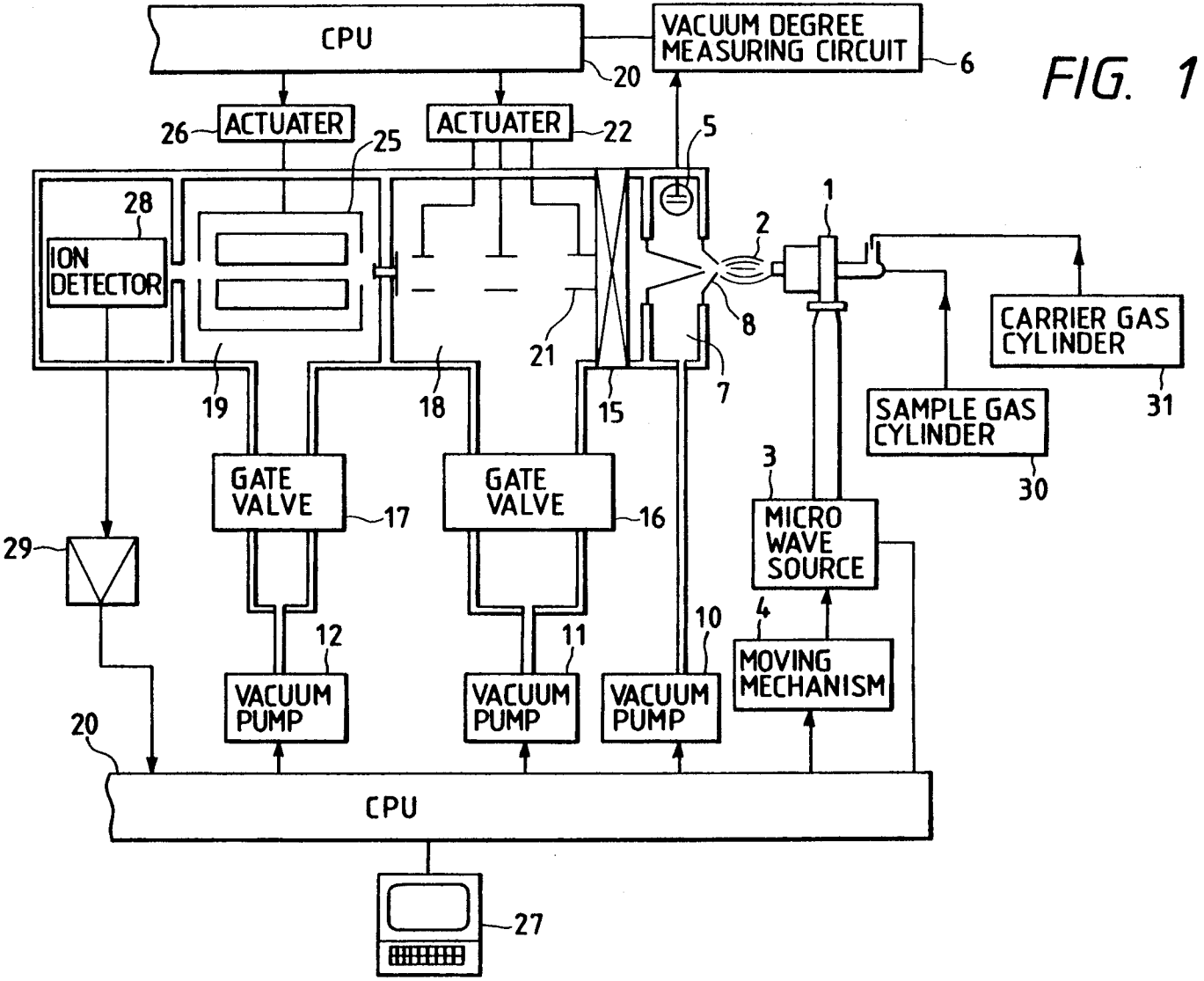
FIG. 1 is a diagrammatic view of a embodiment of a mass spectrometer in the present invention.

An embodiment of a mass spectrometer applied in MIP/MS (Microwave Induced Plasma Mass Spectrometer) in the present invention is shown in FIG. 1. Of course, in the same way, the present invention may be applied in ICP/MS(Inductively Coupled Plasma Mass Spectrometer).

In FIG. 1, a vacuum system in the mass spectrometer consists of the first vacuum chamber 7, the second vacuum chamber 18 and the third vacuum chamber 19 and vacuum degrees of the respective vacuum chambers are controlled by vacuum pumps 10, 11, 12.

Nebulized sample supplied from a sample gas cylinder 30 and carrier gas such as nitrogen gas etc. supplied from a carrier gas cylinder 31 are mixed together and transmitted into a plasma generating means 1. The carrier gas such as nitrogen gas is changed to plasma, thereby the sample gas is dissociated and atomized so as to be ionized.

A microwave power source 3 is a power source for generating MIP(Microwave Induced Plasma) by changing the carrier gas supplied from a carrier gas cylinder 31 into plasma using microwave of 2.45 GHz, for example, and is controlled by a CPU 20 so as to optimize conditions for generating plasma. The plasma 2 may be ICP(Inductively Coupled Plasma) having a frequency of 27 MHz, for example.

Previously, the vacuum chambers 7, 18, 19 are respectively exhausted by controlling gate valves 16, 17 and pumps 10, 11, 12 based on signals from the CPU 20 and when the vacuum degrees of the vacuum chambers 7, 18, 19 becomes previous value, the plasma is supplied into the first vacuum chamber 7.

The plasma generating means 1 is correctly disposed opposite to the hole on the sampling cone 8 by moving the plasma generating means 1 with a microwave power source 3 using a moving mechanism 4, and thereby the ion data are detected in the highest efficiency and the sensitivity of the mass spectrometer becomes easily and quickly as explained later.

In the first vacuum chamber 7, a vacuum meter 5 is provided and output from the vacuum meter 5 is calculated by a vacuum degree measuring circuit 6 so as to output a corresponding signal to the CPU 20.

Sample ions ionized by the plasma 2 are taken in the first chamber 7 through the hole on the sampling cone 8. Further, the sample ions pass through an interface valve 15 which is opened during ion measuring time , are accelerated and are condensed by the ion lens 21 actuated by an actuator 22, then are deflected according to masses of the ions by a mass analyzing portion 25 actuated by an actuator 26 so as to be detected by ion detector 28 depending on the mass of the sample ions. An amplifier 29 receives outputs from the ion detector 28 and supplies corresponding outputs to the CPU 20.

Figure 2:
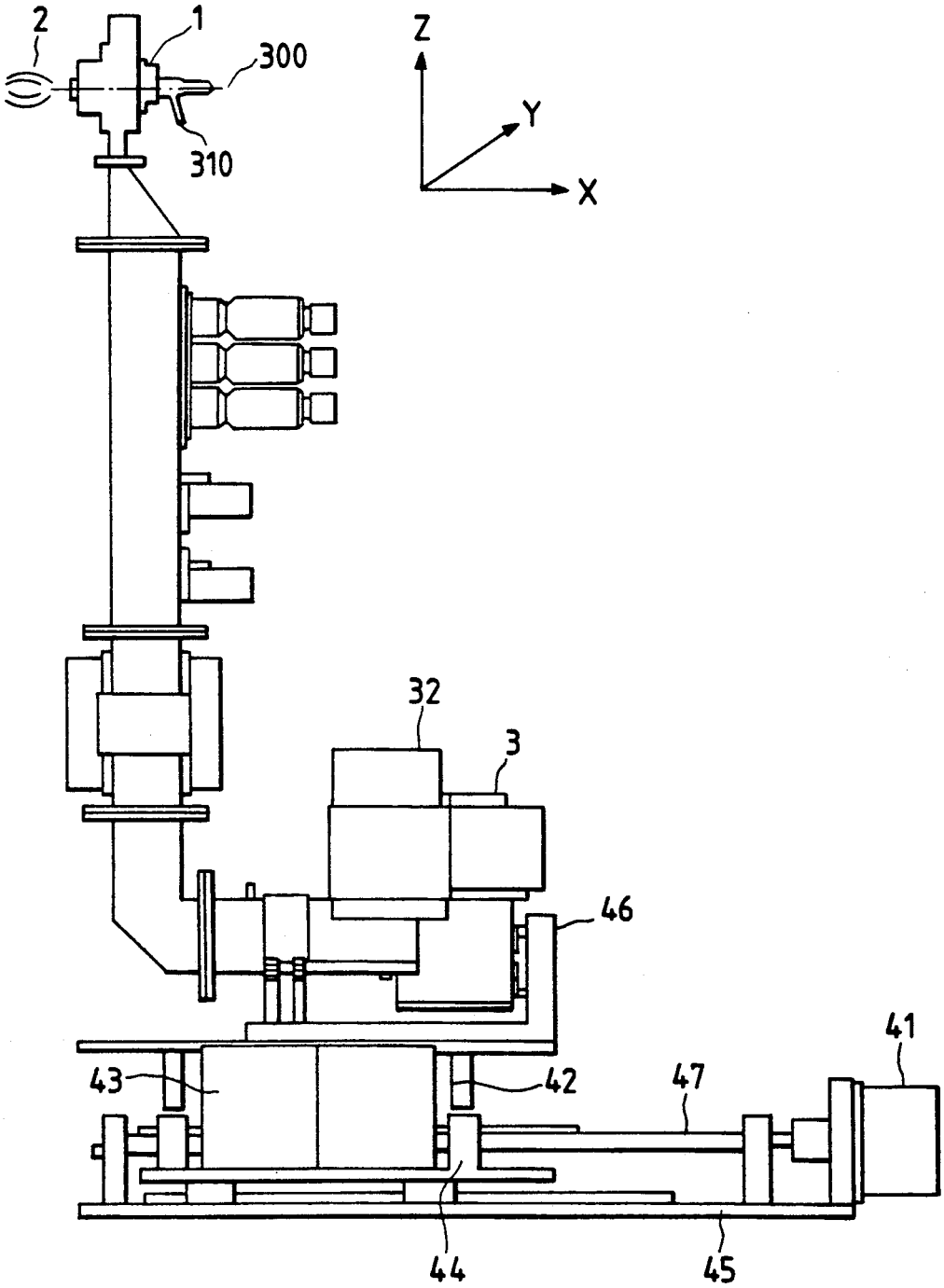
FIG. 2 is a diagrammatic cross-sectional view of a moving mechanism of a plasma generating means 1 shown in the FIG. 1.

The plasma generating means 1, microwave power source 3 and moving mechanism 4 consisting of X axis motor 41, Y axis motor 42, Z axis motor 43, movable stages 44, 46, a fixed stage 45 and a sending screw 47 are constructed as shown in FIG. 2.

The movable stage 44 is moved along a X axis on the fixed stage 45 by the X axis motor 41 and the sending screw 47, thereby length of the plasma between the sampling cone 8 and a nozzle of the plasma generating means 1 is adjusted. The Y axis motor 42 and the Z axis motor 43 are mounted on the movable stage and are moved along a Y axis and a Z axis on a plane opposite to the sampling cone 8. The movable stage 44 mounts the magnetron 32 for generating the microwave and the microwave power source 3 which is the power source of the magnetron 32 and the sample gas supplied from a sample gas supplying hole 300 is ionized by changing the carrier gas from a carrier gas supplying hole 310 into the plasma state.

Figure 3:
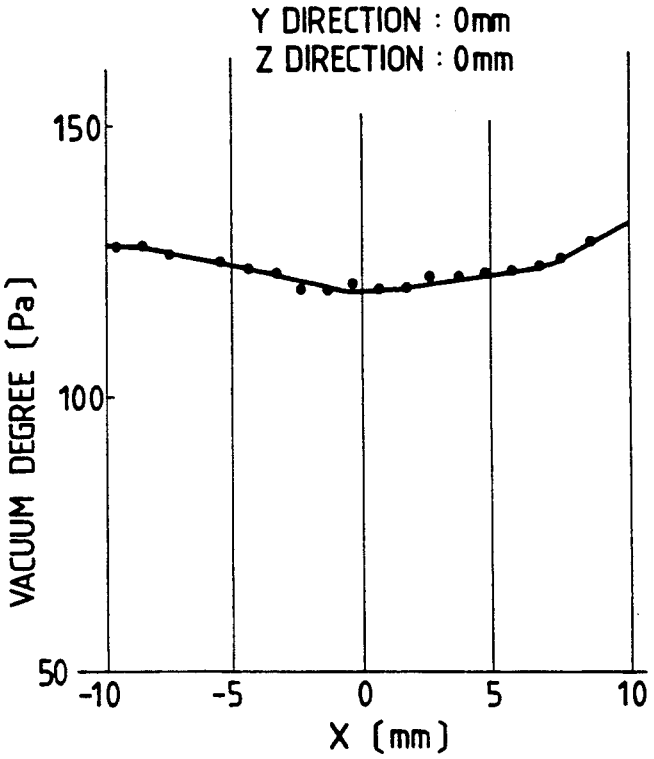
FIGS. 3 and 4 are graphs showing relations between positions of the plasma generating means 1 and vacuum degrees in a vacuum chamber 7 closed to a hole of a sampling cone 8 shown in the FIG. 1.
Figure 4:
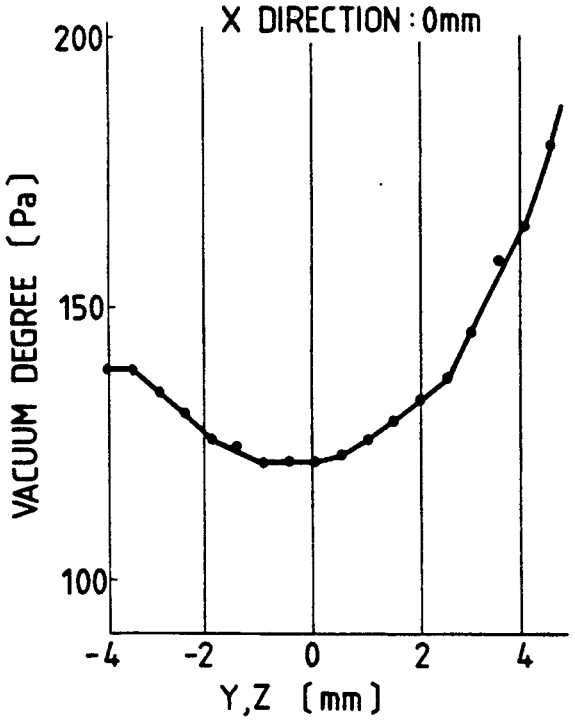

FIGS. 3 and 4 show vacuum degrees in the first vacuum chamber inside of the sampling cone 8 which are measured during the plasma generating means 1 is moved along the X axis, the Y axis or the Z axis.

In FIGS. 3, the vacuum degree is measured by moving the plasma generating means 1 along the X axis holding the plasma 2 at a central of the hole of the sampling cone 8. It is apparent from FIGS. 3 that there is a minimum point of the vacuum degree in O point of the X axis, but the vacuum degree changes very slightly.

In FIGS. 4, the vacuum degree is measured by moving the plasma generating means 1 along the Y or Z axis holding the plasma generating means 1 at O position of the X axis. FIGS. 4 shows that the vacuum degree changes widely. When the plasma 2 is positioned at the central of the hole of the sampling cone 8, that is, Y or Z=0, the vacuum degree becomes minimum, in which the vacuum state is the best, and becomes extremely worse according to the distance which the plasma 2 leaves from the central of the hole.

Figure 5:
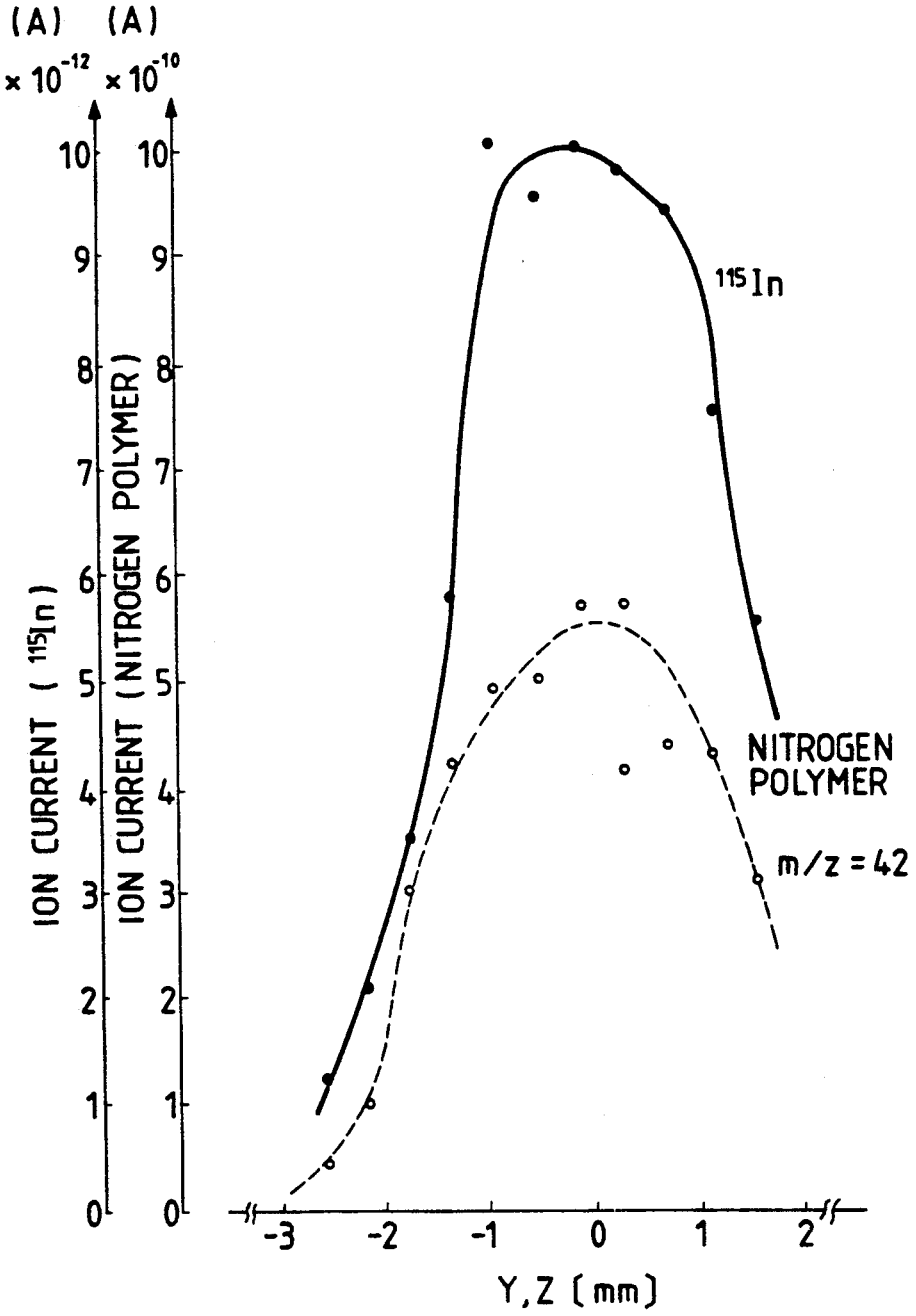
FIG. 5 is a graph showing a relation between positions of the plasma generating means 1 and an ion current detected by ion detector 28 shown in the FIG. 1.

Furthermore, FIG. 5 shows a relation between the ion current from the ion detector 28 and the position of the plasma generating means 1 in the Y or Z direction. When the plasma 2 is positioned at the central of the hole of the sampling cone 8, the ion current from the ion detector 28 becomes maximum and becomes extremely worse according to the distance which the plasma 2 leaves from the central of the hole.

Therefore, when the vacuum degree which is detected by the vacuum meter 5 is the best at the position within −1 to +1 mm of the Y or Z axis, the detected ion current from the ion detector 28 becomes maximum. Using these relation in the present invention, the position of the plasma generating means 1 is controlled by detecting the vacuum degree which is in the minimum so as to make the ion current from the ion detector 28 the maximum manually or automatically.

As the plasma for ionizing the sample gas is moved to the position where the vacuum degree of the vacuum chamber becomes minimum so as to make the ion current from the ion detector the maximum as stated above, the ion current is effectively detected and the sensitively of the mass spectrometer is easily adjusted to be maximum.

We claim:

1. A mass spectrometer for analyzing ultra trace element using plasma ion source comprising;

a plasma generating means for ionizing sampling gas by generating plasma, a vacuum chamber for taking in ions of the sampling gas from a hole of the vacuum chamber;

an ion lens installed in the vacuum chamber for condensing ions of the sampling gas;

a mass analyzing portion installed in the vacuum chamber for affecting the ions according to masses of the ions; and an ion detector for detecting the ions which are passed through the ion lens and the mass analyzing portion; wherein further comprising, a moving mechanism for moving said plasma generating means according to a vacuum degree measured in the vacuum chamber.

2. A mass spectrometer for analyzing ultra trace element using plasma ion source as defined in claim 1, characterized in that, said vacuum chamber has a means for measuring the vacuum degree in a space being adjacent to the hole and the moving mechanism moves said plasma generating means according to the vacuum degree from the vacuum measuring means.

3. A mass spectrometer for analyzing ultra trace element using plasma ion source as defined in claim 1, characterized in that, said moving mechanism moves the said plasma generating means and stops it at a position where the vacuum degree becomes minimum.

4. A mass spectrometer for analyzing ultra trace element using plasma ion source as defined in claim 1, characterized by further comprising, a CPU for calculating a moving distance of the moving mechanism according to the vacuum degree.

5. A mass spectrometer for analyzing ultra trace element using plasma ion source as defined in claim 4, characterized in that, said CPU calculates the moving distance of the moving mechanism where the vacuum degree becomes minimum.

6. A mass spectrometer for analyzing ultra trace element using plasma ion source comprising;

a plasma generating means for ionizing sampling gas by generating plasma, a first vacuum chamber for taking in ions of the sampling gas from a hole of the first vacuum chamber;

an ion lens installed in a second vacuum chamber connected to the first vacuum chamber for condensing ions of the sampling gas from the first chamber;

a mass analyzing portion installed in a third vacuum chamber connected to the second vacuum chamber for deflecting the ions condensed by the ion lens according to masses of the ions; and an ion detector for detecting the ions which are passed through the ion lens and the mass analyzing portion; wherein further comprising, a moving mechanism for moving said plasma generating means according to a vacuum degree measured in the first vacuum chamber.

7. A mass spectrometer for analyzing ultra trace element using plasma ion source as defined in claim 6, characterized in that, said first vacuum chamber has a means for measuring the vacuum degree in a space being adjacent to the hole and the moving mechanism moves said plasma generating means according to the vacuum degree from the vacuum measuring means.

8. A mass spectrometer for analyzing ultra trace element using plasma ion source as defined in claim 6, characterized in that, said moving mechanism moves the said plasma generating means and stops it at a position where the vacuum degree becomes minimum.

9. A mass spectrometer for analyzing ultra trace element using plasma ion source as defined in claim 6, characterized by further comprising, a CPU for calculating a moving distance of the moving mechanism according to the vacuum degree.

10. A mass spectrometer for analyzing ultra trace element using plasma ion source as defined in claim 9, characterized in that, said CPU calculates the moving distance of the moving mechanism where the vacuum degree becomes minimum.

* * * * *